US007607899B2

(12) United States Patent
Van Praag et al.

(10) Patent No.: US 7,607,899 B2
(45) Date of Patent: Oct. 27, 2009

(54) COMPRESSOR WITH CAPACITY CONTROL

(75) Inventors: Wouter Van Praag, Kapellen (BE); Paul Emmanuel Philomena Verbraeken, Edegem (BE)

(73) Assignee: Atlas Copco Airpower, naamloze vennootschap, Wilrijk (BE)

( * ) Notice: Subject to any disclaimer, the term of this patent is extended or adjusted under 35 U.S.C. 154(b) by 264 days.

(21) Appl. No.: 10/517,602

(22) PCT Filed: Jul. 24, 2003

(86) PCT No.: PCT/BE03/00129

§ 371 (c)(1),
(2), (4) Date: Jul. 8, 2005

(87) PCT Pub. No.: WO2004/018878

PCT Pub. Date: Mar. 4, 2004

(65) Prior Publication Data

US 2006/0018769 A1 Jan. 26, 2006

(30) Foreign Application Priority Data

Aug. 22, 2002 (BE) ..... 2002/0495

(51) Int. Cl.
*F04B 23/00* (2006.01)
*F04B 41/00* (2006.01)

(52) U.S. Cl. ..... 417/440

(58) Field of Classification Search ..... 417/410.4, 417/441, 213, 298; 418/84, 97, 201.2
See application file for complete search history.

(56) References Cited

U.S. PATENT DOCUMENTS 3,105,630 A * 10/1963 Lowler et al. ..... 417/295
3,367,562 A * 2/1968 Olofsson et al. ..... 417/295
3,788,776 A * 1/1974 Post et al. ..... 417/295
4,068,980 A * 1/1978 Fine et al. ..... 417/282
4,358,247 A * 11/1982 Suzuki et al. ..... 417/13
4,388,046 A * 6/1983 Boller ..... 417/295
4,406,589 A * 9/1983 Tsuchida et al. ..... 417/295
4,498,848 A * 2/1985 Petrovsky et al. ..... 417/253
4,529,363 A * 7/1985 Suzuki ..... 417/295
4,553,906 A * 11/1985 Boller et al. ..... 417/295
4,642,033 A * 2/1987 Boller ..... 417/295

(Continued)

FOREIGN PATENT DOCUMENTS

BE 1012655 A3 * 2/2001

(Continued)

*Primary Examiner*—Charles G Freay
*Assistant Examiner*—Alexander B Comley
(74) *Attorney, Agent, or Firm*—Bacon & Thomas, PLLC

(57) ABSTRACT

Compressor containing a pressure regulating system (8) comprising an inlet valve (9); a piston (23) in a cylinder (24) connected thereto; a bridge (14) of this inlet valve (9) with a non-return valve (16) in it, characterized in that the piston (32) is a double-acting piston; the cylinder (24) on the side of the piston (23) turned away from the inlet valve is connected to a part (13) of the rotor chamber (2) situated near the inlet valve (9) via a pipe (28); and the cylinder (26) on the other side of the piston (23) is connected to the above-mentioned part (13) of the rotor chamber (2) and the non-return valve (16) via a pipe (29).

6 Claims, 3 Drawing Sheets

Figure 1:
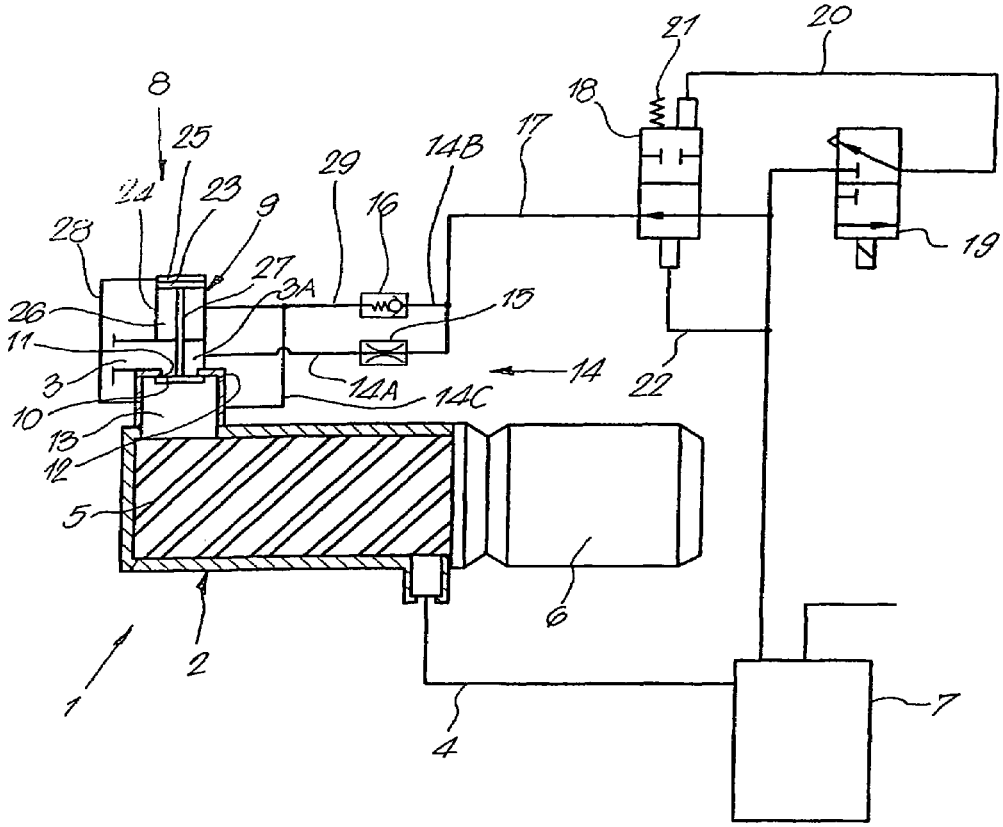

U.S. PATENT DOCUMENTS 4,642,034 A * 2/1987 Terauchi ..... 417/295
4,708,599 A * 11/1987 Suzuki ..... 417/295
4,998,862 A * 3/1991 Hutchinson ..... 417/28
5,318,151 A * 6/1994 Hood et al. ..... 184/6.1
6,146,100 A * 11/2000 Broucke ..... 417/28
6,474,953 B2 * 11/2002 Van De Putte ..... 417/44.2
6,866,490 B2 * 3/2005 Daniels et al. ..... 418/97
2004/0151601 A1 * 8/2004 Daniels et al. ..... 417/298

FOREIGN PATENT DOCUMENTS

EP 1004774 A2 * 5/2000
GB 2133585 A * 7/1984

* cited by examiner

COMPRESSOR WITH CAPACITY CONTROL

The present invention concerns a compressor containing a compressor element which is provided with a rotor chamber onto which are connected an inlet pipe and an outlet pipe, a reservoir in the outlet pipe and a pressure regulating system comprising an inlet valve erected in the inlet pipe, a piston which is connected to the inlet valve and which can be moved in a cylinder, a bridge bridging said inlet valve and in which, between the inlet pipe and the rotor chamber, are successively erected a gas stream limiter and a non-return valve which only admits gas into the rotor chamber, and a gas pipe connecting the reservoir to the part of the bridge situated between the gas stream limiter and the non-return valve, and a relief valve erected in said gas pipe.

Depending on certain parameters such as operating pressure, temperature, leakages, delivery or the like, or depending on a specific compressed air network and the length of the pipes, or also, depending on the type of application or the like, a certain type of compressor element will have to be selected which has to meet the total consumption under the worst conditions.

In reality, however, there will be variations in certain of the above-mentioned parameters. When the compressed air consumption is lower than the production, the pressure in the pipes will rise. When the operational pressure is reached in the network of pipes, the production of compressed air will be stopped in order to prevent unacceptable high pressures being created. After a while, the pressure in the pipes will reduce again due to leakages, consumption or the like and, depending on the application, pressure will have to be built up again in order to prevent the operational pressure from dropping under an unacceptable limit.

For compressors with rotors, such as screw-type compressors, the pressure-regulating system described in the first paragraph, also called a load and relief system, is one of the most frequently used regulating systems to allow for a production of compressed air from 0 to 100% with a minimum of energy loss.

In the case of such compressors, the variations in the consumption of compressed air are adjusted by opening and closing the inlet valve and the pressure relief in the reservoir.

As soon as the operational pressure reaches a certain level, the pressure regulating system makes sure that the inlet valve of the compressor element is closed. The supply of inlet air is in this manner reduced to zero percent, and the compressor element will run idle. The air supply at the outlet pipe, in particular at the reservoir which is usually erected in it, is stopped. When the inlet valve is closed, the pressure regulating system simultaneously activates a time switch which makes sure that the drive of the compressor element keeps on working for a certain period.

If no specific pressure difference occurs after this period, the pressure regulating system will order the drive to be stopped. If, however, a pressure difference occurs after the aforesaid period, the compressor element will keep on working and the pressure regulating system will order the inlet valve to be opened again, so that pressure can be built up again.

When the drive has come to a standstill and the pressure level in the outlet pipe is too low, the pressure regulating system will order the compressor element to be started, whereby the inlet valve is opened.

With known compressors of the above-mentioned type, the pressure regulating system contains a strong spring, built-in in the cylinder and pushing on the side of the piston which is turned towards the inlet valve, while the cylinder chamber situated on the other side of the piston is connected to the reservoir via a control line, equipped with an electromagnetic control valve.

When the rotors are driven at the initial start-up, the control valve is not excited, and the pressure in the reservoir is close to the atmospheric pressure. The relief valve in the gas pipe is open and, under the influence of the spring on the piston, the inlet valve is closed. Due to the underpressure created in the rotor chamber, a small air flow will flow from the inlet pipe through the bridge, over the gas stream limiter and the non-return valve, to the rotor chamber, sufficient to provide for an increase of pressure in the reservoir.

A continuous air flow is created between the bridge, the rotor chamber, the reservoir and over the pneumatic relief valve which has been opened by the built-up pressure, and then back to the bridge. When the drive is ready to run at full load, the control valve is excited, as a result of which the relief valve goes back into the closed position, and the space above the piston in the cylinder is simultaneously put under pressure, and the spring force is overcome, such that the inlet valve is opened. The production of compressed air now amounts to 100%.

When there is more production of compressed air than demanded, and the set pressure in the reservoir is maximal, the excitation of the electromagnetic control valve is stopped, as a result of which this is closed again. The space above the piston is connected to the atmosphere via the control valve, and the relief valve is opened again. As a result, the inlet valve is closed again under the influence of the spring, and the reservoir is vented via the relief valve, the gas pipe and the bridge.

After this venting, the pressure is stabilised at the pressure for idle running, which is sufficient to provide for the injection of lubrication liquid on the rotors. A small amount of air bridges the inlet valve and is sucked into the rotor chamber via the bridge and the non-return valve. The production of compressed air is reduced to a minimum and the compressor turns without producing anything.

As there is a strong spring in the inlet valve, special precautions have to be taken. The mounting and dismounting of the inlet valve is not without any danger because of said spring. Because of the spring, the inlet valve is also relatively expensive. In order to be able to relieve the spring pressure of the inlet valve, an expensive electromagnetic control valve with a large passage diameter is required.

When the relief valve and the inlet valve are controlled simultaneously, malfunctions sometimes occur.

The invention aims a compressor which does not have the above-mentioned disadvantages and which is thus relatively inexpensive, allows for an easy mounting and dismounting of the inlet valve and allows for a reliable control of the inlet valve.

According to the invention, this aim is reached in that the piston is a double-acting piston which divides the cylinder in two closed cylinder chambers, in that the cylinder chamber, on the side turned away from the inlet valve, is connected to a part of the rotor chamber situated near the inlet valve via a pipe, and in that, on the other side of the piston, the cylinder chamber is connected to a part of the rotor chamber situated near the inlet valve and to the non-return valve via a pipe.

Thus, there is no action of a spring on the piston anymore.

The pipe connecting the cylinder chamber on the side which is turned away from the inlet valve to a part of the rotor chamber situated near the inlet valve may as such form the connection between the piston and the inlet valve, and it may for example consist of a stem provided with a duct over its entire length.

The relief valve may then, as in the known pressure regulating systems, be a pneumatic valve which is controlled by a pipe connected directly to the reservoir, a control line having a preferably electromagnetic control valve in it which is also connected to said reservoir, and a spring.

Figure 2:
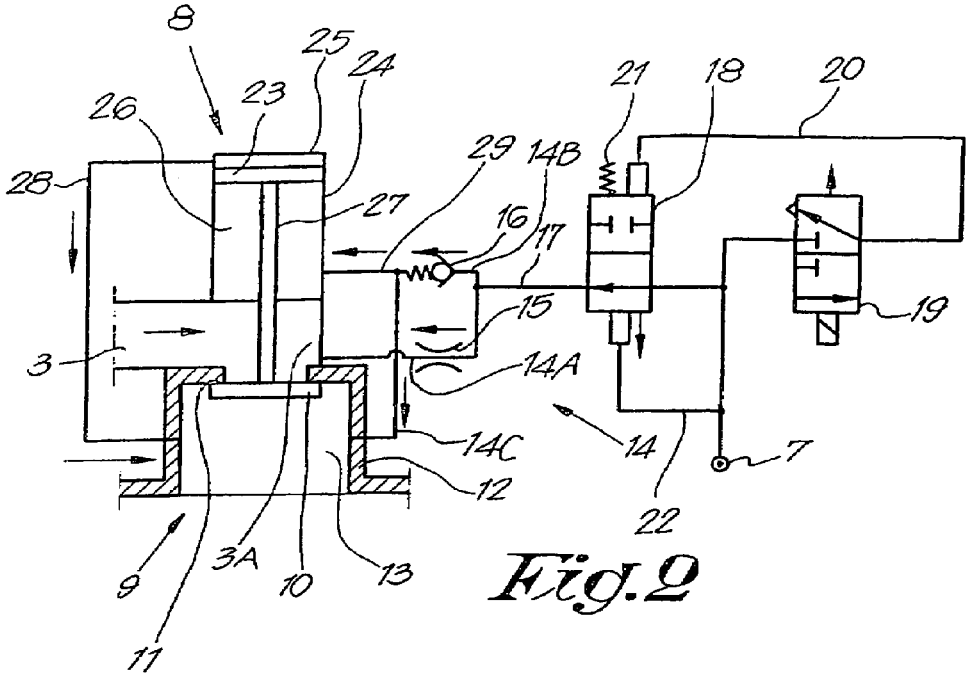
Figure 3:
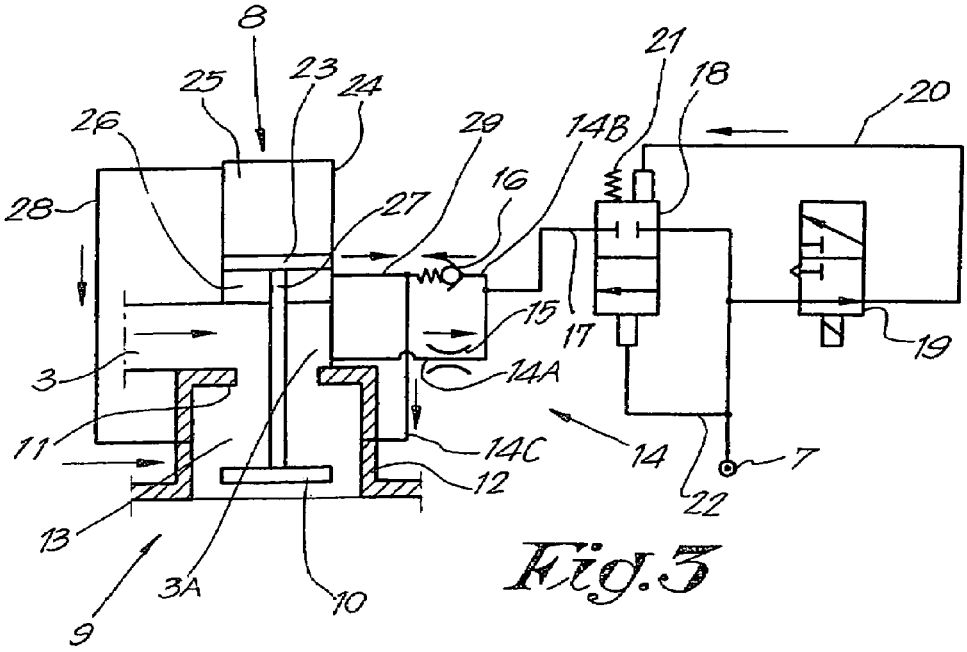
Figure 4:
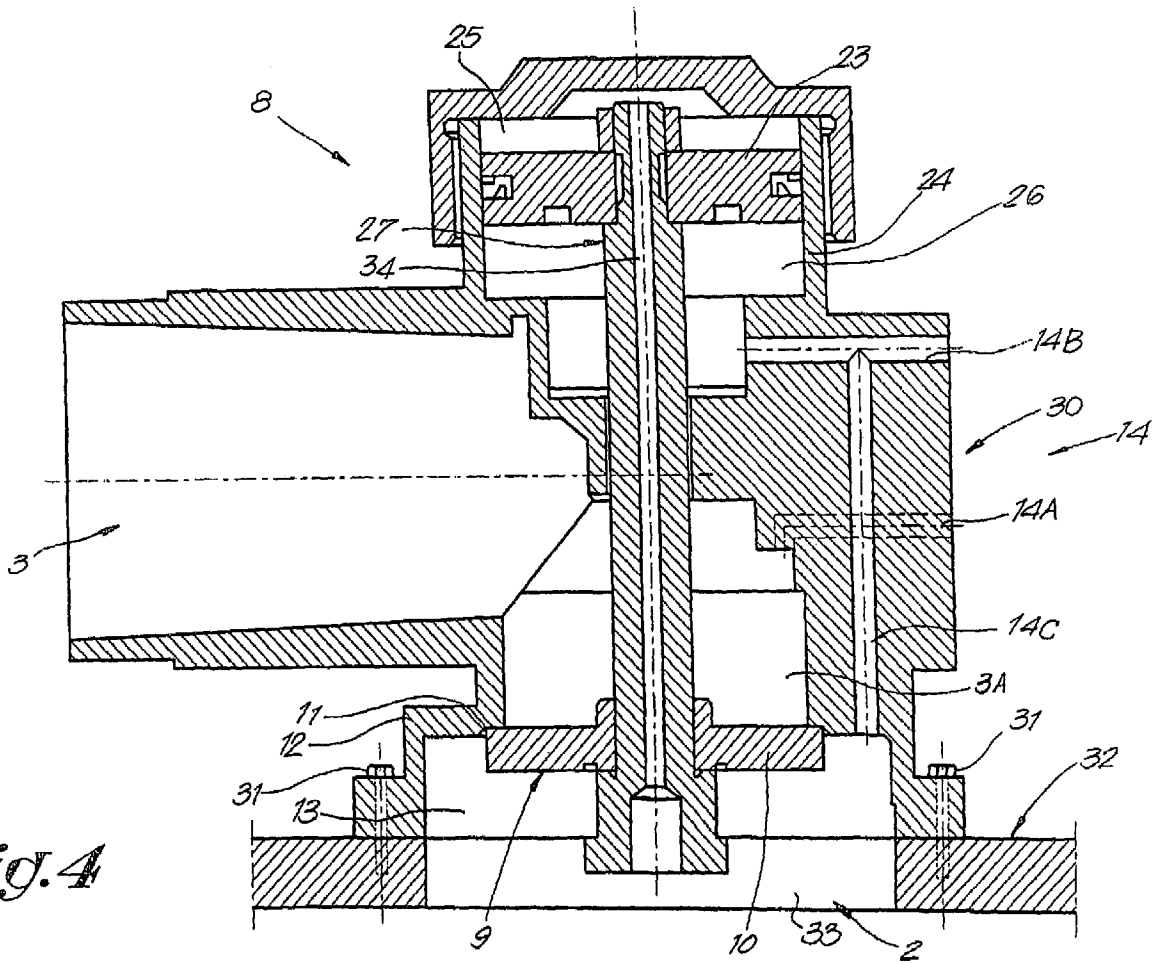

In order to better explain the characteristics of the invention, the following preferred embodiment of a compressor according to the invention is described as an example only without being limitative in any way, with reference to the accompanying drawings, in which:

FIG. 1 schematically represents a compressor according to the invention;

FIG. 2 schematically represents the pressure regulating system of the compressor from FIG. 1 during the start-up;

FIG. 3 schematically represents the pressure regulating system of the compressor from FIG. 1, but when running idle;

FIG. 4 represents a section of a practical embodiment of a part of the pressure regulating system from FIGS. 2 and 3.

The compressor which is schematically represented in FIG. 1 is a screw-type compressor which mainly comprises a compressor element 1 which is provided with a rotor chamber 2 onto which are connected an inlet pipe 3 on the one hand and an outlet pipe 4 on the other hand, and in which are erected two screw rotors 5 working in conjunction which are driven by a motor 6, a reservoir 7 which is erected in the outlet pipe and a pressure regulating system 8.

As is also represented in the FIGS. 2 and 3, the pressure regulating system 8 has an inlet valve 9 with a valve element 10 which works in conjunction with a valve seat 11 in the valve housing 12.

There where the inlet pipe 3 opens into the rotor chamber 2, the latter forms a protruding inlet chamber 13 in which the valve element 10 is in the open position.

The inlet valve 9 is bridged by a bridge 14 in which the inlet valve 3 and the inlet chamber 13 are successively provided, a gas stream limiter 15 and a non-return valve 16 which only allows a gas stream into the inlet chamber 13.

The part of the bridge 14 situated between the gas stream limiter 15 and the non-return valve 16 is connected to the reservoir 7 via a gas pipe 17. In this gas pipe 17 is erected a pneumatic relief valve 18 having an open position and a closed position.

The relief valve 18 is controlled by an electromagnetic control valve 19 in a control line 20 which is connected to the reservoir 7 or, as represented in FIG. 1, between this reservoir 7 and the relief valve 18, to the gas pipe 17 on the one hand, and which is connected to the far end of the relief valve 18 on the other hand, onto which also acts a spring 21. On the other far end, which is connected to the reservoir 7 or the part of the gas pipe 17 situated between the relief valve 18 and said reservoir 7 via a pipe 22, the pressure acts in the reservoir 7.

In one position, the control valve 19 opens the control line 20, and in another position, it closes off said control line 20 on the side of the reservoir 7, while it connects the control line to the atmosphere on the side of the relief valve 18.

The pressure regulating system 8 further comprises a double-acting piston 23 which can be moved in a cylinder 24 and which divides this cylinder 24 in two closed cylinder chambers 25 and 26. The piston 23 is connected to the valve element 10 of the inlet valve 9 by means of a stem 27, such that they move together.

The cylinder chamber 25 on the side of the piston 23 which is turned away from the inlet valve 9 is connected to the inlet chamber 13 via a pipe 28, whereas the other cylinder chamber 26 is connected to the part of the bridge 14 situated before the non-return valve 16 and the gas stream limiter 15 via a pipe 29 or, as is represented in FIG. 1, via the non-return valve 16 to the part of the gas pipe 17 connected onto this part of the bridge 14.

When the compressor is initially started up, the pressure in the reservoir 7 is close to the atmospheric pressure. The control valve 19 is not excited and the part of the control line 20 connected to the relief valve 18 is connected to the atmosphere such that, under the influence of the spring 21, the relief valve is closed and closes off the gas pipe 17.

The motor 6 must easily reach its maximum speed. A small air flow flows out of the inlet pipe 3 via the bridge 14 into the rotor chamber 2, which is sufficient to build up a pressure in the reservoir 7.

When the pressure being built up in the reservoir 7, which acts on the relief valve 18 via the pipe 22, neutralises the operation of the spring 21, the relief valve 18 will go into its open position, as represented in FIG. 2.

Thanks to the open relief valve 18, the pressure being built up in the reservoir 7 is also available in the cylinder chamber 26, as a result of which the piston 23 is being held in the top position, so that the inlet valve 9 remains closed. There is an underpressure in the inlet chamber 13, as a result of which the valve element 10 is drawn open, but this force is compensated because the same underpressure prevails in the cylinder chamber 25 via the pipe 28. The diameter of the valve element 10 and the diameter of the piston 23 are selected such that the vacuum forces exerted upon it compensate each other.

There is a continuous air flow from the reservoir 7, over the open relief valve 18 and the bridge 14 and the compressor element 1, and back to the reservoir 7.

When the motor 6 is ready for a full load, the electromagnetic control valve 19 is excited, as a result of which the control line 20 opens, as represented in FIG. 3.

The pressure of the reservoir 7 now acts, via the control line 20 on the one hand and via the pipe 22 on the other hand, on the relief valve 18, and the spring 21 will push the relief valve 18 into the closed position, as is also represented in FIG. 3.

As a result, the reservoir 7 is no longer vented via said relief valve 18 and the gas pipe 17. The cylinder chamber 26 is no longer connected to the reservoir 7, but to the inlet chamber 13 via the bridge 14 where there is an underpressure which also prevails in the cylinder chamber 25 via the pipe 28. Vacuum forces draw the valve element 10 into the open position. The result of the forces on the piston 23 and on the valve element 10 is a force which makes the inlet valve 9 open.

The compressor operates at full load, and the production of air amounts to 100%.

When the production of compressed air exceeds the demand, the pressure in the reservoir 7 will rise, and as soon as it reaches a specific value, the pressure regulating system will stop the excitation of the control valve 19, so that this control valve 19 interrupts the control line 20 again and brings the part thereof which is connected to the relief valve 18 in connection with the atmosphere.

As described for the start-up, the relief valve 18 will as a result thereof go into its open position, and the inlet valve 9 will close again. The condition as represented in FIG. 2 is created again.

The reservoir 7 is vented via the gas pipe 17, over the open relief valve 18 and the bridge 14, partly over the gas stream limiter 15 in the inlet pipe 3, and partly over the non-return valve 16 in the inlet chamber 13.

After this venting, the pressure will stabilise at the pressure for idle running, which pressure is sufficient to provide for the injection of lubrication liquid on the rotors.

The compressor again not only sucks a small amount of air through the bridge 14, which amount of air flows back to the bridge 14 via the gas pipe 17. The compressor in this manner keeps on running idle, without delivering compressed air.

After a pre-programmed length of time, the pressure in the reservoir 7 is measured by the pressure regulating system 8 and, when there has been no pressure drop, also the motor 6 will be stopped.

In case of a pressure drop in the reservoir 7 as a result of a diminution of air, the motor 6 will keep on running and the pressure regulating system 8 will excite the control valve 19 again, so that the condition as represented in FIG. 3 is created again, with an open inlet-valve 9 in the above-described manner.

By making use of the above-described pressure-regulating system 8, it is possible to use a inexpensive electromagnetic control valve 19 with a small passage, and the relief valve 18 will be more reliable as the air flow, through the control valve 19, only has to control said relief valve 18 and not the piston 23 in the cylinder 24.

Moreover, it is not necessary to use a heavy spring acting on the piston, which is safe and non-expensive, and as a result of which the cylinder 24 can be made compact.

How the cylinder 24 and the inlet valve 9 as a whole can be made very compact in practice is represented in FIG. 4.

The valve housing 12, the cylinder 24 and a far end 3A of the inlet pipe 3 have been united into a single housing 30 which is fixed on the rotor housing 32 by means of bolts 31.

Also the inlet chamber 13 is present in this global housing 30 and forms a whole with an opening 33 in the rotor housing 32.

The two far ends of the bridge 14 are also ducts 14A and 14C provided in said body 30 and opening on the side of the far end 3A of the inlet pipe 3 in relation to the valve element 10, in the inlet chamber 13 respectively.

The gas pipe 29 is formed of a duct 29 provided in said housing 30 connecting the cylinder chamber 26 with a bridge 14 between duct 14B and 14C.

In this compact embodiment, the pipe 28 is formed of the above-mentioned stem 27 upon which the piston 23 and the valve element 10 are fixed, and which is provided with a duct 34 over its entire length which opens into the cylinder chamber 25 on the one hand, and into the inlet chamber 13 or opening 33 on the other hand.

It is clear that the gas which is compressed in the compressor must not necessarily be air. It may also be another gas, such as a gaseous cooling medium.

The present invention is by no means limited to the above-described embodiment given as an example and represented in the accompanying drawings; on the contrary, such a compressor can be made in different shapes and dimensions while still remaining within the scope of the invention.

The invention claimed is:

1. A compressor, containing a compressor element, and comprising: a rotor chamber connected to an inlet pipe and an outlet pipe; a reservoir in communication with the outlet pipe; a pressure regulating system including an inlet valve associated with the inlet pipe; a piston connected to the inlet valve and which is movable in a cylinder to open and close the inlet valve without the use of a spring acting on the piston; a bridge bridging said inlet valve and in which, between the inlet pipe and the rotor chamber, are successively mounted a gas stream limiter and a non-return valve which only admits gas into the rotor chamber; a gas pipe connecting the reservoir to a part of the bridge situated between the gas stream limiter and the non-return valve; and a relief valve associated with said gas pipe, wherein the piston is a double-acting piston which divides the cylinder into first and second closed cylinder chambers; the first cylinder chamber, on a first side of the piston facing away from the inlet valve, is connected to a part of the rotor chamber located near the inlet valve upstream the rotor chamber via a first pipe, wherein the connection is always open; and on a second side of the piston, the second cylinder chamber is connected to a part of the rotor chamber situated near the inlet valve and to the non-return valve via a second pipe.

2. The compressor according to claim 1, wherein the first pipe connecting the first cylinder chamber on the first side which is turned away from the inlet valve to a part of the rotor chamber situated near the inlet valve forms the connection between the piston and the inlet valve.

3. The compressor according to claim 2, wherein the connection between the piston and the inlet valve comprises a stem provided with a duct extending over an entire length of the stem.

4. The compressor according to claim 1, wherein the relief valve comprises a pneumatic valve which is equipped with a spring and which is connected by a pipe which is directly connected to the reservoir and a control line which is also connected to said reservoir via a control valve.

5. The compressor according to claim 4, wherein the control valve is an electromagnetic valve.

6. The compressor according to claim 1, wherein the inlet valve includes a housing forming a common housing with the cylinder.

* * * * *

UNITED STATES PATENT AND TRADEMARK OFFICE

CERTIFICATE OF CORRECTION

PATENT NO. : 7,607,899 B2
APPLICATION NO. : 10/517602
DATED : October 27, 2009
INVENTOR(S) : Van Praag et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 658 days.

Signed and Sealed this

Twelfth Day of October, 2010

David J. Kappos

David J. Kappos
*Director of the United States Patent and Trademark Office*